United States Patent [19]

Novoselac et al.

[11] 4,432,748

[45] Feb. 21, 1984

[54] CENTRIFUGE APPARATUS AND METHOD OF OPERATING A CENTRIFUGE

[75] Inventors: John Novoselac; Dale L. Churcher, both of Cambridge, Canada

[73] Assignee: Joy Manufacturing Company, Pittsburgh, Pa.

[21] Appl. No.: 905,695

[22] Filed: May 15, 1978

Related U.S. Application Data

[63] Continuation-in-part of Ser. No. 720,200, Sep. 3, 1976.

[51] Int. Cl.[3] ..... B04B 1/16

[52] U.S. Cl. ..... 494/2; 494/37; 494/5

[58] Field of Search ..... 233/20 R, 20 A, 27, 233/46, 47 R, 28, 14 R, 14 A, 19 R, 19 A; 494/2, 5, 37

[56] References Cited

U.S. PATENT DOCUMENTS

| | | | |
|---|---|---|---|
| 439,173 | 10/1890 | Newbery et al. | 233/47 R |
| 1,100,872 | 6/1914 | Hall | 233/46 |
| 1,101,548 | 6/1914 | Hoffman | 233/27 |
| 1,328,084 | 1/1920 | Hackett . | |
| 1,585,393 | 5/1926 | Laughlin . | |
| 1,613,579 | 1/1927 | Hinchley et al. . | |
| 2,087,727 | 7/1937 | Bath . | |
| 2,178,547 | 11/1939 | Bjornstjerna . | |
| 2,378,778 | 6/1945 | Lindgren et al. . | |
| 2,394,015 | 2/1946 | Schutte et al. . | |
| 2,578,456 | 12/1951 | Smith . | |
| 2,733,856 | 2/1956 | Kjellgren . | |
| 2,750,040 | 6/1956 | Strich . | |
| 2,821,340 | 1/1958 | Wijngaaden . | |
| 2,878,995 | 3/1959 | Dega | 233/27 |
| 3,081,027 | 3/1963 | Coulson . | |
| 3,085,742 | 4/1963 | Palmquist . | |
| 3,087,645 | 4/1963 | Eddy et al. . | |
| 3,119,775 | 1/1964 | Wilsmann et al. . | |
| 3,179,334 | 4/1965 | Sharples . | |
| 3,233,535 | 2/1966 | Fowlie . | |
| 3,273,790 | 9/1966 | Dahlberg . | |
| 3,281,068 | 10/1966 | Baram . | |
| 3,297,243 | 1/1967 | Hein . | |
| 3,297,244 | 1/1967 | Hein . | |
| 3,347,456 | 10/1967 | Kobbernagel . | |
| 3,408,001 | 10/1968 | Nilsson . | |
| 3,410,481 | 11/1968 | Dahlberg et al. . | |
| 3,494,544 | 2/1970 | Thylefors . | |
| 3,532,265 | 10/1970 | Baram . | |
| 3,535,158 | 10/1970 | McBride et al. . | |
| 3,582,934 | 6/1971 | Zumhulsen . | |
| 3,593,915 | 7/1971 | Steinacker . | |
| 3,599,861 | 8/1971 | DeMartini . | |
| 3,623,657 | 11/1971 | Trump . | |
| 3,666,170 | 5/1972 | Cacciabue . | |
| 3,750,940 | 8/1973 | Nilsson . | |
| 3,774,840 | 11/1973 | Boatright . | |
| 3,777,972 | 12/1973 | Kjellgren . | |
| 3,799,431 | 3/1974 | Lavanchy et al. . | |
| 3,823,868 | 7/1974 | Baram . | |
| 3,825,177 | 7/1974 | Kohlstette et al. . | |
| 3,854,657 | 12/1974 | Pause . | |
| 3,863,838 | 2/1975 | Pronk . | |
| 3,871,575 | 3/1975 | Niemeyer . | |

FOREIGN PATENT DOCUMENTS

| | | | |
|---|---|---|---|
| 466290 | 10/1951 | Italy | 233/18 |
| 829940 | 3/1960 | United Kingdom . | |
| 1005117 | 9/1965 | United Kingdom . | |
| 1199880 | 7/1970 | United Kingdom | 233/20 R |

*Primary Examiner*—George H. Krizmanich

[57] ABSTRACT

This invention relates to centrifuges and more particularly to a centrifuge having a separation chamber surface profile to provide a uniform or controlled flow of separated solids and the method of operating a centrifuge to provide such flow.

26 Claims, 7 Drawing Figures

CENTRIFUGE APPARATUS AND METHOD OF OPERATING A CENTRIFUGE

This application is a continuation-in-part of the copending application Ser. No. 720,200, filed Sept. 3, 1976.

Centrifugal separators or centrifuges for numerous applications are well known in the art for separating fluid mixtures into relatively higher density and lower density fractions with one particular application being to continuously centrifugally separate solids from a slurry having a high water content to permit the solids to be transported by pumping to a location at which the solids are to be used. Thus, for example, coal-water slurries are dewatered at the discharge end of a transporting pipeline to provide a mine backfill material is also well known in the prior art, however, to date there are no mining systems which centrifugally dewater mill tailings slurries underground due to the inability of present separators to either handle such slurries, or provide a usable discharge, or to provide a sufficient quantity of discharge to accomplish backfilling in a practical manner. The advantages of providing a backfill material of a desired consistency are more fully described and claimed in copending patent application Ser. No. 773,991 and the disclosure thereof is incorporated in this application to provide a better understanding of this invention. As is known mill tailings result from processing ores and having a range of particle sizes therein within a range of 600 microns to submicron size being typical which fine particles can advantageously be utilized in backfilling. Of the various types of separators presently available, screen type centrifuges are not satisfactory for dewatering mill tailings slurries as they are not designed to handle fine particles. In order to obtain a large quantity of dewatered mill tailings underground the slurry has a solids content as high as practical, with typical prior high solids content slurry having a solids content of 50 to 70 percent by weight. Solids content in such range are too high to permit separation by disc bowl or self-ejecting centrifuges. Also for underground dewatering the mill tailings slurries it is necessary to use and transport the centrifuge within the confines of the mine passageways which eliminates using any large size centrifuges such as solid bowl or conveyor type centrifuges. For the same reasons the use of a number of prior centrifuges in parallel or sequence is not practical underground.

The centrifuge of this invention overcomes the above disadvantages of prior centrifuges by providing a centrifuge of a physical size which can readily be located and transported within existing passageways in an underground mine and which can discharge dewatered mill tailings at a rate to provide the quantity of backfill as is required in underground mining. In particular the separator bowl is of a configuration or profile to establish a volume of solids (herein identified as a beach zone) which profile, after the beach zone is established, controls the rate of solids discharge from the centrifuge so that the rate of material discharge equals or substantially equals, as desired, the rate of solids removed from the incoming slurry.

Accordingly, one object of this invention is to provide a new and improved centrifuge having a continuous discharge of a high solids content material relative to the solids content of an incoming slurry.

Another object of this invention is to provide a centrifuge having a bowl configuration to provide a continuous controlled discharge of material therefrom.

Still another object of this invention is to operate a centrifuge to establish a beach of material within the centrifuge to isolate the separating and discharge functions of the centrifuge.

A more specific object of this invention is to operate a centrifuge so that the rate at which the solid particles of a slurry are deposited within a zone of the centrifuge is equal to or substantially equals, as desired, the rate at which such particles are discharged from the centrifuge.

Another object of this invention is to operate a centrifuge having a continuous discharge of a material primarily consisting of solid particles in which the rate of discharge may be varied.

Another object of this invention is to operate a centrifuge having a maintained volume of low liquid content mixture within the bowl that acts as the transport for centrifugal particles to be discharged.

Another more specific object of this invention is to provide a centrifuge having any one of selectable bowl profiles to provide a uniform flow or movement of deposited solid particles through a zone in the centrifuge which isolates the separating and discharge portions of the centrifuge.

These and other objects of this invention will become more apparent upon consideration of the following description of the presently preferred embodiments of the invention and the drawings thereof in which.

Figure 1:
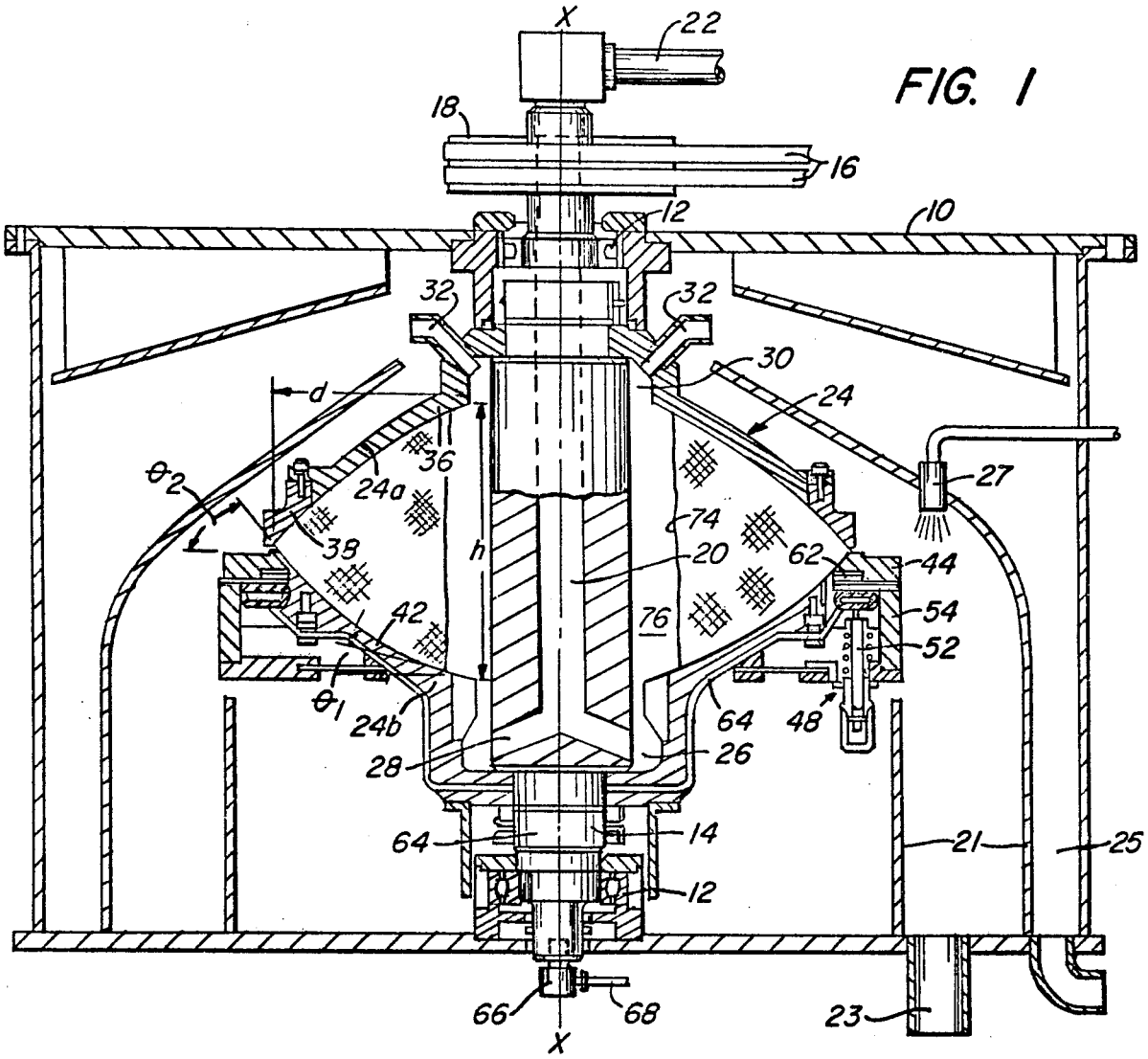
FIG. 1 is an axial cross section of a centrifuge constructed according to the principles of this invention.

Centrifuges of the rotary bowl type as shown in FIG. 1 are well known in the art and comprise a stationary formed housing 10 having vertically spaced and aligned bearings 12 for rotationally supporting an elongated shaft 14 about vertical rotaion axis X—X of the housing 12. Shaft 14 is rotationally driven as set forth herein by means of a controllable motor (not shown) having drive belts 16 cooperable with a pulley 18 rigidly secured to the shaft 14 upwardly adjacent the housing 10. Shaft 14 is provided with a central vertically extending passageway 20 therein with the upper end being open and cooperable with a feed pipe assembly 22 to supply the material i.e. the slurry, to be separated in the centrifuge. A separation chamber or bowl 24, comprising upper and lower formed members **24*a* and 24*b*, respectively, suitably rigidly secured to shaft 14 to rotate therewith, is located within housing 10. The lowermost portion of the lower bowl member 24*b* is provided with an acceleration chamber 26 in open communication with ports 28 extending laterally and downwardly from the inner end of passageway 20. The upper bowl portion 24*a* has an uppermost central annular chamber 30 encompassing the upper portion of the shaft 14 within the bowl 24 with circumferentially spaced discharge ports 32 extending upwardly and outwardly of the chamber 30 and in open fluid communication therewith. As described in detail hereinafter the upper and lower portions 24*a* and 24*b* form a material discharge opening 34** therebetween at their outer periphery.

In operation the mixture to be subjected to centrifugal action of the centrifuge is introduced through the feed pipe assembly 22 and thereafter flows through passageway 20, ports 28 acceleration chamber 26 into bowl 24 in which the mixture is separated with the low density fraction thereof being discharged through ports 32 and the high density fraction thereof being discharged through opening 34. For the purposes of this invention the construction of the feed pipe assembly, drive, bearings, shaft, acceleration chamber, discharge ports, and housing may be of various well known forms such that further description thereof is not necessary to the understanding of this invention. In the preferred embodiment illustrated the accelerator chamber 26 is of a structure as shown, described and claimed in the copending patent application Ser. No. 773,991 and accordingly the disclosure of such application is incorporated herein for the purpose of describing the preferred embodiment of this invention.

Figure 2:
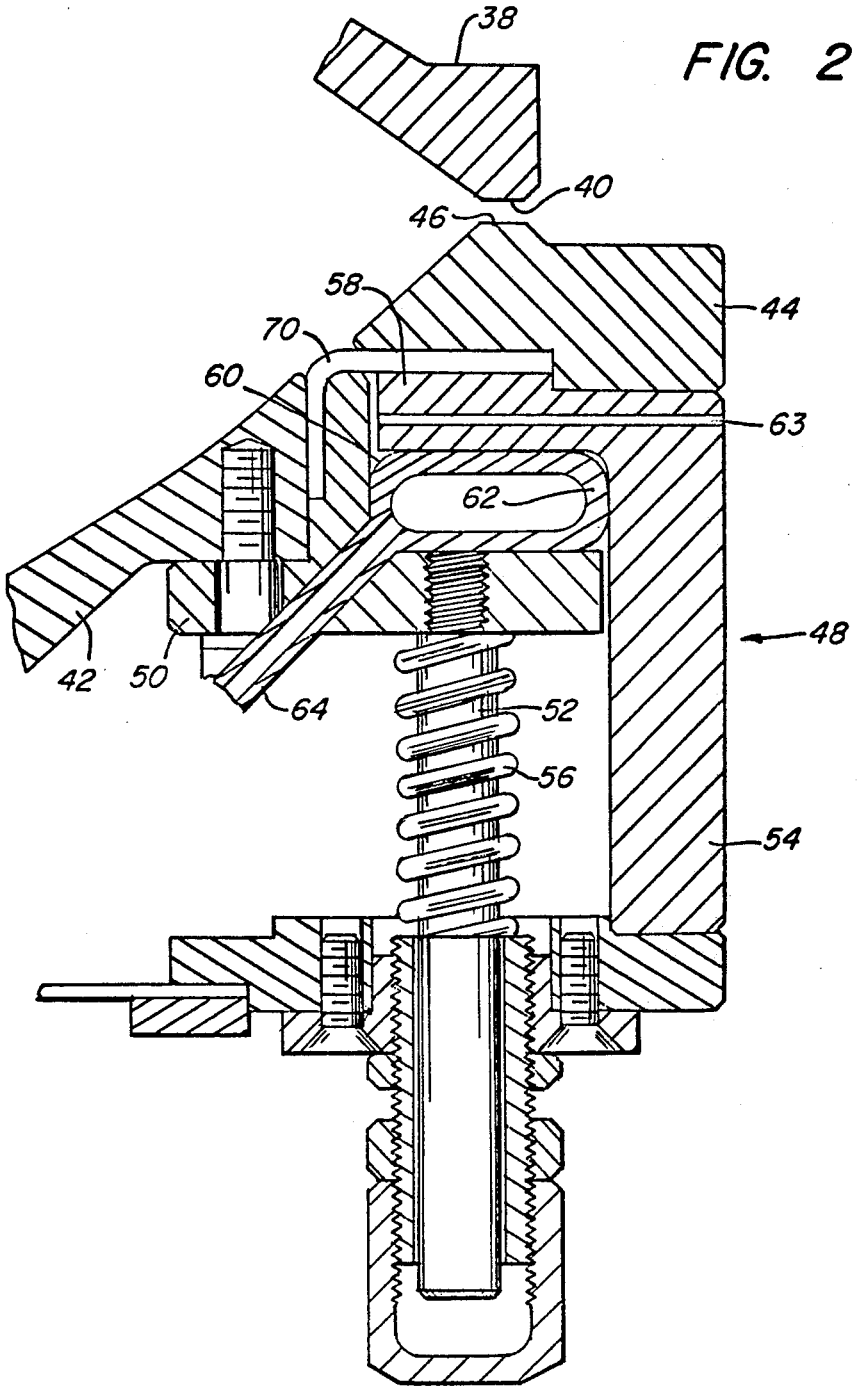
FIG. 2 is an enlarged cross-sectional view of the outer peripheral portion of the rotating portion of the centrifuge as shown in FIG. 1.

Upper bowl member **24*a* has a generally conical disc portion 36 which extends outwardly and downwardly from the portion of bowl member 24*a* forming chamber 30. A formed ring member 38 is suitably removably secured to the lower end of the disc portion 36 and has an inner bowl surface of a form to provide a smooth configuration of the inner curvature of disc portion 36 and a lower edge 40, FIG. 2, in a plane extending transversely of the vertical axis of shaft 14. The lower bowl member 24*b* also has a generally conical disc portion 42 which extends outwardly and upwardly from the portion of bowl member 24*b* forming the accelerator chamber 26. A formed ring member 44 is movably supported by the disc portion 42 at the outer end thereof for controlled movement toward and away from the ring member 38. Ring member 44 has an inner bowl surface of a form to provide a smooth continuation of the inner curvature of disc portion 36 and an upper edge 46 extending in a plane extending parallel to the lower edge 38. Ring member 44 is suitably selectively moved towards and away from the ring member 38 by suitable circumferentially spaced mechanisms 48, only one of which is shown in FIG. 1. One particular mechanism 48 for controlling the movement of ring member 44 is more particularly shown, described and claimed in patent application Ser. No. 773,911 and the disclosure of such application is incorporated therein for a more complete description of the mechanism 48. Also, in this description the term radial is with reference to the rotation axis X—X, the term axial is with reference to the rotation axis X—X or any axis parallel thereto, and the terms upper and lower and the like are used for convenience in this description with respect to the showing of FIG. 1**.

Each mechanism 48 has a seal adaptor 50 suitably rigidly secured to a radially outer portion of the disc portion 42, or preferably, seal adaptor 50 is a ring member common to all mechanisms 48 having a suitable plurality of uniformly circumferentially spaced integral guide pins 52 depending downwardly therefrom having centers on a circle coaxial with the axis X—X. Piston assemblies 54 are supported by pins 52, respectively, for axial relative movement with suitable springs 56 being interposed between the seal adaptor 50 and the piston assemblies 54, respectively, to bias the piston assemblies 54 outwardly from the seal adaptor 50. Each piston assembly 54 is suitably rigidly secured to the lower portion of ring member 44 so that axial movement of the piston assemblies 54 cause a corresponding axial movement of the ring member 44 within the limits of travel of ring member 44. Piston assemblies 54 have an inwardly extending circumferentially continuous flange portion 58 upwardly overlying a radially outer circumferentially continuous portion of the seal adaptor 50 to form a chamber 60 therebetween extending circumferentially around the lower disc portion 42. A hollow annular flexible control member 62 is located within chamber 60 and is of a form to be closely received therein. A suitable number of tubular supply lines 64 are in fluid communication with the interior of the control member 62 and extend radially inwardly and downwardly of chamber 60 through seal adaptor 50 along the outer surface of the lower bowl member **24*b*, through the lower portion of bowl member 24*b* into registry with the open end of a supply passageway 64 extending from the exterior of the shaft 14 to the center thereof and then coaxially downwardly of shaft 14 into registry with a suitable air flow control device 66 having a suitable controllable supply line 68 connected thereto. Although any suitable fluid may be utilized to pressurize the chamber 60, pressurized air is preferred due to its availability, the known controls for air, and the minimal inertial effect thereof; accordingly, air will be described as the operating fluid for the control member 62 herein. The control means 66 may be of any suitable type to permit air to be controlled as described herein and suitable known fittings are employed between the described portions of the air supply system. A suitable circumferentially continuous flexible seal 70, having one portion secured between the seal adaptor 50 and the disc portion 42 and another portion secured between the upper portion of the piston assembly 54 and a lower surface of ring member 44, is provided to prevent material from within the bowl 24 from entering the chamber 60 upon movement of the ring member 44 upwardly away from the seal adaptor 50. A suitable vent line 63 open to the atmosphere is provided within the piston assembly 54 to prevent any air pressure buildup within chamber 50 or below the seal 70** in any suitable manner.

Although the principles of this invention can be employed to build various types of centrifuges the preferred embodiment illustrated has been designed for use in dewatering mine or mill tailings as are commonly used in backfilling in mining operations and accordingly the description of the invention is with reference to such mill tailings. It is a primary object of this invention to provide a continuous discharge of mill tailings from the centrifuge of this invention and in order to achieve such continuous discharge from an incoming mill tailings slurry it is necessary to establish a relatively, as described hereinafter, impervious beach zone within the rotating bowl 24 of the centrifuge. Such beach zone is accomplished by admitting the mill tailings slurry to the centrifuge, as described, and rotating, typically at 400 to 600 rpm, the centrifuge at a speed lower than the normally operational speed with the discharge gap between edges 40–46 closed. Springs 56 bias the member 44 away from the member 38 so that the discharge gap is normally open. The discharge gap is closed and maintained closed by controllably admitting pressurized air from supply 68 through passageway 64, and line 64 to the interior of control member 62. By proper supply pressure of the pressurized air causes the control member 62 to flex within chamber 60 to move the piston assembly 54, with the ring member 44 attached, so that edge 46 firmly engages the edge 40. Such air is supplied at a pressure to overcome the bias of the springs 56 and to provide the necessary contact pressure between edges 40–46A. Any air within chamber 60 surrounding the control member 62 is vented upon the expansion of member 62 through line 62 to the atmosphere. With the discharge gap closed the solids of the incoming and rotating slurry are separated by centrifugal action and accumulated in the radial outermost portions of the interior of the bowl 24. The liquid content of the slurry is discharged through ports 32 and is handled in any suitable manner such as by lines (not shown) discharging into a tank for permitting the pumping of the collected liquid to a location as desired. Preferably the liquid content is pumped to the surface for use in forming subsequent mill tailings slurry. The admission of slurry and the rotation of the centrifuge is continued until the buildup of the solid particles is of a depth extending radially inwardly from the discharge gap and a consistency so that the discharge gap can be opened without discharging the deposited solids. Such deposited solids occupy the greater portion of the bowl 24 and define a generally cylindrical surface 74 spaced radially outwardly of shaft 14 which is the innermost surface of the beach. By so operating the centrifuge surface 74 occurs at a location radially outwardly of the accelerator portion 26 and extends generally vertically between the inner surfaces of the disc portions 38–42.

Figure 6:
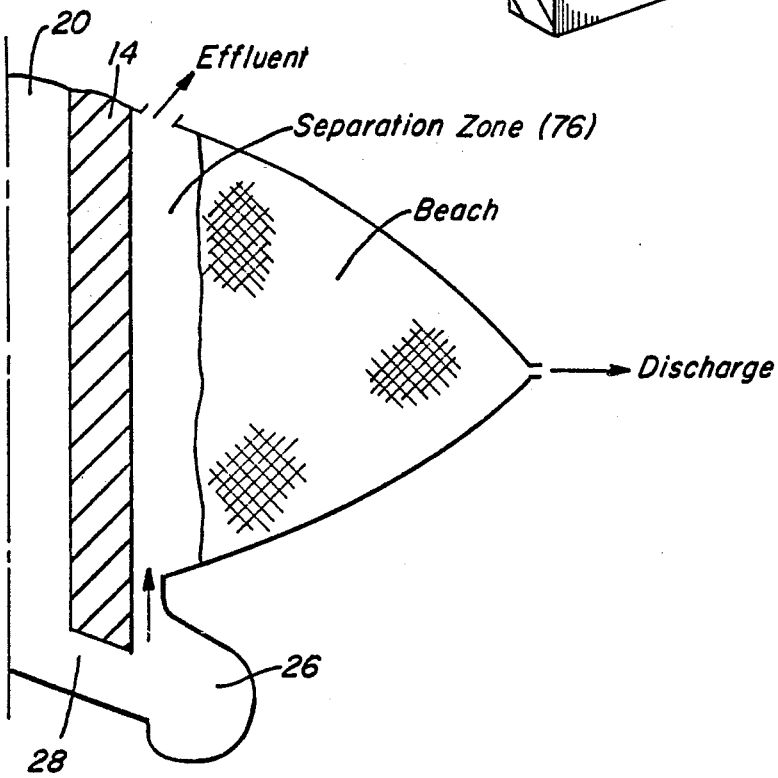
FIG. 6 is a diagrammatic representation of the various zones within the bowl of the separator as shown in FIG. 1; and, FIG. 7 is a diagrammatic representation of a partial cross section showing various zones and shapes within the centrifuge bowl.

In order to provide for a continuous discharge of such deposited solids the discharge gap is opened to the desired width and the operating speed of the centrifuge increased to a speed at which initiation of the discharge of deposited solids occurs through the discharge gap. The speed at which such discharge is initiated is hereinafter referred to as the threshold speed and typically is 100 to 300 rpm higher than the rpm utilized to establish the beach. The discharge gap is opened by reducing the air pressure from the central member 62 by suitable operation of the control 66. The threshold speed is not necessarily the operating speed of the centrifuge and to obtain a continuous discharge of deposited solids from a high solids content slurry a centrifuge speed of between 1400 and 3200 rpm has proved to be satisfactory. Other operating speed above or below this range may be used in some applications. At such operating speed three distinct functional zones occur within the bowl 24, i.e. FIG. 6, a separation zone 76 extending as an annulus around shaft 14 to which slurry is admitted from the acceleration chamber 26 and effluent is discharged from the upper portion through discharge ports 32, a beach zone extending from the separating zone 76 to the discharge zone and having the inner surface 74, and a discharge zone between the surfaces 40–46 and radially inwardly adjacent thereto. As the incoming slurry enters the separation zone 76 the solids therein due to their higher relative density with respect to the transporting water vehicle move, with respect to net direction of flow, radially of the separation zone 76 and are deposited on the radially innermost portion of the beach zone. The beach zone serves as an accumulating chamber for such deposited solids and isolates the discharge zone from the separation zone whereby the separating process can be accomplished independently of the discharge of material. Since the separating and discharge are isolated the centrifuge can be operated with reference to the requirements of the separating process provided that the requisite material discharge occurs. Accordingly, the discharge zone is adjustable in this invention to provide the material discharge required for the desired separation process. By obtaining operation of the centrifuge with reference to the requirements of the separating process the smallest solid particles can be deposited in the beach zone and a clear water is discharged through ports 32 so that all the solids of the slurry are utilized in the material discharge. As hereinafter discussed there are many interrelated factors which effect the deposition of solids and it has been found practical to allow an effluent discharge through ports 32 containing 5% by weight of the smaller particle solids of the slurry.

Since the centrifuge is operated with reference to the requirements of the separation process the rate at which solid particles are deposited in the beach zone determine the rate at which the deposited solids are to be discharged. Accordingly, the discharge gap must be of a configuration to permit deposited material to be discharged at the required rate, i.e. equal to the rate at which solids are deposited in the beach zone. A discharge of deposited material at a rate higher than the rate at which solids are deposited would, over a period of time, cause the elimination of the beach. A rate of discharge lower than the rate of deposition would cause surface 74 of the beach zone to shift radially towards the shaft 14 and reduce the volume of separation zone which reduction would cause more solids to be contained in the effluent discharge due to the higher velocity of water flow through the separation zone resulting from the decrease in volume of the separation zone. With the centrifuge of this invention some radial movement of the surface 74 can be tolerated without adversely effecting the operation of the centrifuge.

The distance over which the interface between the separation zone and the beach zone, i.e. surface 74, can move radially is determined by the radius of surface 74, hereinafter called the blow-out radius, at which the beach zone cannot be maintained since the volume of deposited solids is insufficient to contain the hydrostatic pressure being exerted upon the beach zone; and the radius of surface 74, hereinafter called the wash-out radius, below which deposited solids at the interface of the beach zone enter the separation zone are all reentrained in the water vehicle and are discharged through ports 32 and/or some solid particles in the incoming slurry are not deposited in the beach zone and are discharged through ports 32. Since the blow-out radius is larger than the wash-out radius the surface 74 can safely shift radially between a radius slightly smaller than the blow-out radius and slightly larger than the wash-out radius.

The deposition rate of solids in a centrifuge of the type disclosed is dependent upon various factors with the principle factors being the speed of the centrifuge, the characteristics of the solids content of a slurry when acted upon by centrifugal force, the rate at which the slurry enters the centrifuge, and the solids content of the slurry. Although centrifuge speed can be controlled the other factors vary substantially for various backfilling operations so that as a result it is difficult to control the rate of solids deposition. For a given backfill operation in which the mill tailings are produced in a constant manner and the amount of transport water and the transport system is known for a particular location the rate of solids deposition can be fairly well controlled; however, as variations in the pipe system and location occur a given rate of solids deposition is not practical other than for a specific mine location. Consequently with this invention the balance required for continuous operation is achieved by controlling the rate at which the deposited solids are discharged. The discharge rate is determined by various factors with the principal factors being the centrifuge speed, size and shape of the discharge opening, properties of the material being discharged and the manner in which the deposited material flows through the beach zone. An important aspect of this invention is providing the bowl 24 with an inner surface configuration or profile to control the flow of deposited material through the beach zone such that the resultant material discharge is uniform. Since the flow resistance of the deposited solid particle is dependent upon the flow characteristics of the material and the forces, hydrostatic and centrifugal, acting upon the beach zone, the bowl profile is selected with reference to the particular material within the beach zone and the operating conditions for the centrifuge.

Figure 3:
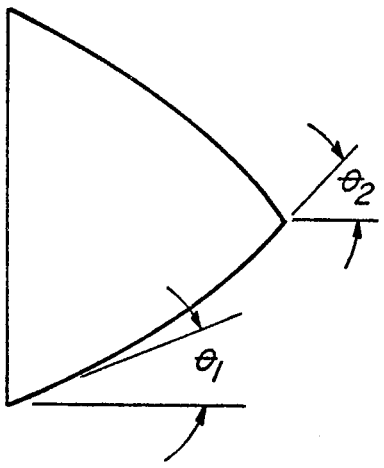
FIG. 3 is an enlarged schematic illustration of the interior configuration of the bowl of the centrifuge as shown in FIG. 1.

In addition, the bowl profile is determined by the control functions to be provided in the bowl 24. Thus, the initial slope of the inner surface of the bowl 24 radially outward of surface 74 is selected to maintain equality between the rate of solid deposition and the rate at which the deposited material moves outwardly from shaft 14 in such initial area. The final slope of the inner surface of the bowl 24 determines the rate of material discharge and the manner in which the deposited material flows into the discharge gap. The intermediate slope or transition slope of the inner surface of the bowl 24 between the initial and final slopes provides the control to accept the volume of material from the initial slope and to provide the volume of material required by the discharge portion. Consequently the interior profile of bowl 24 for a selected material and centrifuge operation provides a selected resistance to material flow to ensure uniform and controlled material movement through the beach zone. The terms uniform flow and controlled flow do not relate to having deposited particles move in a precise pattern or manner within the beach zone but specify the overall resultant flow of the deposited particles through the beach zone in which individual particles may have entirely different movements. As shown, FIG. 3, the inner surface of the bowl 24 is provided with a variable slope in which the slope of the bowl increases with respect to the increase in radius from the rotation axis X—X to impose a higher resistance to material flow as the centrifugal force acting upon the material increases. Such profile imposes the optimum flow resistance on the beach zone at all bowl 24 radii and in particular the inner surfaces of the bowl member 24*a* and 24*b* may be mirror images. As shown, the inner surface of the lower member 24*b* extends an an angle $\theta_1$ to the radial direction at its radially inner extent adjacent the chamber 26 and an angle $\theta_2$ to the radial direction at its radially outer extent adjacent discharge 34. An intermediate surface portion of member 24*b* extends radially between the respective innermost and outermost portions along a curvalinear path such that at each succeedingly larger bowl radius in the surface of member 24*b* forms a respectively larger angle with the radial direction such that the interior profile of the bowl 24 is of a concave form. The increase of surface profile angle with respect to the radial direction with increasing bowl radius imposes progressively larger flow resistance on each material element in the beach zone as it flows radially outward thereby compensating for increased centrifugal force on the solids load at such larger radii and helping to establish and maintain uniform movement of particles through the beach zone.

Figure 4:
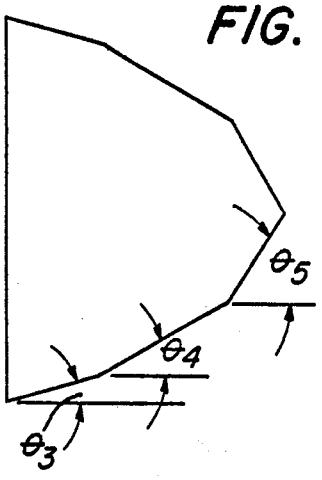
FIG. 4 is a schematic illustration similar to FIG. 3 of the interior configuration of an alternate embodiment of a centrifuge bowl constructed according to the principles of this invention.

The angle of bowl surface profile to radial direction need not increase continuously from the inner radii outward. For example an alternative surface profile (FIG. 4) comprises a plurality of contiguous linear profile portions with the portions located at respectively larger radii forming respectively larger angles $\theta_4$, $\theta_5$ and $\theta_6$ to the radial direction. Other profile configurations providing an increased surface profile angle to the radial direction at successively larger bowl radii may also be used.

In practice for a centrifuge used for dewatering slurried mill tailings, an angle $\theta_1$ of 13½ degrees has proven to be very satisfactory; however, the angle $\theta_1$ can vary within a range dependent upon the latitude available in designing the centrifuge. Changing the angle $\theta_1$ varies the rate of flow of the particles within the beach; accordingly, the angle $\theta_1$ is selected to provide for the uniform flow described with the maximum cross section of discharge gap 34. For such a centrifuge an angle $\theta_2$ in the range of 40 to 60 degrees has proven to be very satisfactory angles out of this range may be used in some applications; however, the angle $\theta_2$ can also be varied, as desired, with relation to the variations of the angle $\theta_1$ or as desired independently of the angle $\theta_1$ to provide such uniform flow and maximum cross section of the discharge gap 34.

Another important aspect of bowl geometry is the height to depth ratio or h/d of the separation chamber as indicated in the left half portion of the bowl 12 in FIG. 1. Generally a small height to depth ratio provides a more stable beach than a large ratio. For example with a large ratio, that is relatively large bowl axial height h and small radial depth d, the beach zone exhibits instability in that relatively small changes in the operation of the centrifuge, such as bowl rotational speed, feed concentration, feed rate may disrupt uniform beach flow as by precipitating a gradient of increasing beach flow rate toward the axially central portion of the beach zone. Ultimately such disruption may cause non-uniform percolation of effluent, destroy the uniformity of the interface 74, or cause a beach blowout or collapse as described. The optimum height to depth ratio of course will depend largely on other parameters of the system, notably the physical properties of the material to be separated, but generally will be in the range of 0.75 to 1.5 or more specifically in the range of 0.9 to 1.2 for a centrifuge to be used for processing a solids concentrated slurry of mill tailings.

With the profile of the bowl 24 established with reference to the incoming slurry and operating speed, the balance required for continuous operation is obtained by varying the width of the discharge gap. Accordingly, after the beach zone has been established and the operational speed obtained, the control member 62 is depressurized by discharging the pressurized air therein to atmosphere by the control 66. The width of the discharge gap is adjustable throughout the axial extent of movement of the ring member 44 by varying the air pressure within the control member 62. Accordingly, the discharge gap is maintained at the width to obtain the equality between the deposition rate and the discharge rate. Should any of the operational parameters vary during the operation of the centrifuge, such as slurry feed rate or the solids content of the slurry, the discharge gap can be varied by pressurizing or depressurizing the control member 62 as desired to maintain such equality. For example, if the feed rate suddenly drops below the operational level less solids will be deposited at the beach interface 74 and in order to maintain this interface 74 within the allowable radial distance, the material discharge rate is decreased by increasing the inflatable seal pressure to reduce the gap width. Conversely, if the discharge rate needs to be increased, the seal pressure is lowered which results in a wider gap. Since the function of the control device 62 is to move the ring member 44 via the piston assemblies 54 the control device 62 and chamber 60 may be of any suitable configuration to provide such movement.

Figure 5:
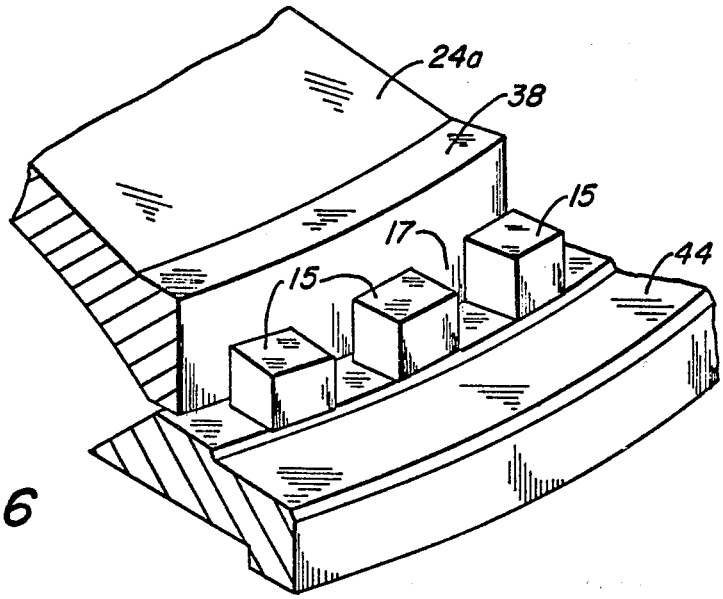
FIG. 5 is a partial perspective view of an alternate structure for the lower discharge ring of the centrifuge as shown in FIG. 1.

Although the continuous peripheral material discharge gap as described is preferred, if desired, other forms of discharge gap may be employed. A satisfactory alternate discharge gap is obtained by, FIG. 5, providing the ring member 44 with integral, or rigidly secured separate members, upwardly extending square block portions 15 radially outwardly adjacent the discharge gap previously described and which block portions 15 are of uniform configuration and uniformly circumferentially spaced to provide uniform width and height slots 17 therebetween through which material is discharged. With such structure the cross-sectional area of the discharge opening is reduced which causes a corresponding reduction in material discharge. Such lower material discharge rate is desired in instances where the solid particles content of an incoming slurry is not particularly high. With this modification the circumferential extent of openings 17 are approximately the same as the circumferential extent of the individual blocks 15.

Housing 10 is provided with suitable interior annular radially spaced wall members 21 into which the material from the centrifuge is discharged and subsequently removed in any suitable manner through one or more suitable lowermost outlets 23 in communication with the annulus between the wall members 21. The radially outermost wall member 21 forms, in conjunction with the walls of housing 10, a formed annular chamber 25 for receiving discharge water from the discharge ports 32. Water chamber 25 is connected by one or more suitable discharge ports 33 to permit the desired disposal of the discharged water effluent. Ring members 38 and 44 are subject to wear due to the discharge of material therebetween and accordingly are replaceable. If desired, ring members 38 and 44 can be made in suitable sections to permit their replacement. Further, a suitable inlet means 27 can be provided to permit the addition of cement to the material discharged from the centrifuge to provide a resultant material as more fully described in application Ser. No. 773,911. Also since the centrifuge described has rotating components such components rotate coaxially with respect to the axis X—X and are radially located to prevent rotational unbalance force from occuring within the centrifuge.

Thus, the invention described provides a centrifuge and method of operating a centrifuge for continuously removing solid particles from a continuous flow of incoming slurry by isolating the centrifuge separation zone from the centrifuge discharge zone whereby the design of the centrifuge is made with reference to the physical requirements for centrifugal separation of such particles. Such isolation is achieved by retaining and controlling the continuous movement of deposited particles through a zone, identified as the beach zone, between the separation zone and the discharge zone for a period of time such that the forces on the deposited particles do not adversely effect the movement of the particles through the discharge zone.

In particular with the invention the hydrostatic pressure on the interface between the separation zone and the beach zone provides a force to assist the movement of the deposited particles through the beach zone and the beach zone is of a composition to withstand the pressure gradient between the interface (as described herein) and the discharge zone. Further, the hydrostatic pressure of the water content of the incoming slurry is sufficiently high to cause percolation of a limited quantity of water through the beach zone to assist the described flow of the deposited particles. Flow of deposited material in the beach zone is also controlled by means of the inner surface configuration or profile of the separation bowl of the centrifuge which configuration can be varied as described while still maintaining the control function of such profile. This invention also provides a centrifuge which is capable of discharging generally the same consistency of material throughout a wide range of solid particle content, by weight, of the incoming slurry. Mill tailings slurries having solid particle contents from between 30 and 70 percent by weight can be handled to provide the same general consistency of discharged material. The flexibility of the centrifuge of this invention with relation to the variable operating parameters of the centrifuge is obtained by providing both an interface which is locatable within a range of radial locations and a variable material discharge. Thus, for a given discharge opening various changes in operating parameter can be accomodated for by the radial shifting of the interface and conversely, for a given proper radial location of the interface variations in the operating parameters can be accomodated for by varying the cross section of the material discharge opening. Should the radial location of the interface and the cross sectional opening of the discharge gap be effective upon the same operational parameter of the centrifuge the centrifuge of this invention permits the interface to shift radially or the gap to be varied in cross section or a continuation thereof to accommodate for any variation in such parameter.

The centrifuge separates the slurry into a high liquid content portion and a high solid content portion. As previously described the high liquid content portion of the slurry is discharged from the centrifuge and, in some applications this liquid portion is further conditioned or used for the vehicle in making new slurry or further centrifuged to recover additional solids. The actual liquid content of the discharge mixture required to obtain the desired consistency of a mortar varies depending upon the type and size of the solid particles. As an example, experiments including the use of South African copper tailings show a liquid content by weight of 15 to 25% in the discharge mixture gives the consistency of the mortar. For different types of particles a liquid content outside of this range is required to achieve a discharge mixture having the desired flow characteristics. In an apparatus as shown in FIG. 1, the high liquid content portion can be referred to as the overflow and the low liquid content portion as the underflow.

The high solid content portion of the slurry as discharged from the centrifuge is a mixture having the consistency of a mortar. While this discharged mixture has the consistency and flow characterisitics of a mortar, unless cement is added, the mixture does not have the hardening or cementious characteristics of mortar. After the discharged mixture has dried it does stiffen and take a rigid form. If strength and hardening qualities are desired, a cement or similar additive material is added to the mixture. The discharged mixture is a generally homogeneous mixture of the solid particles with a low liquid content exhibiting plastic flow qualities bordering beween a flowable solid, such as for example, an accumulation of sand, and a liquid, such as for example, a slurry. The mixture has an apparent cohesion so as to be directly usable as a wall coating of backfill material. The liquid content gives the mixture a paste form and cohesion properties. The mixture has a medium slump characteristic when self-supported.

Figure 7:
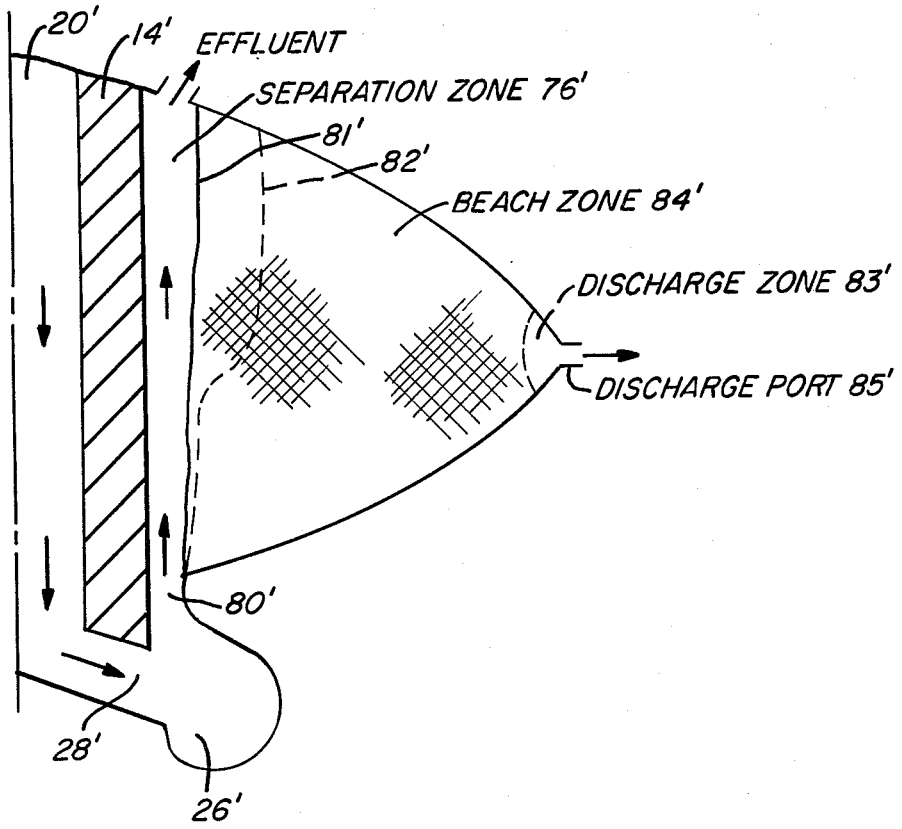

Within the centrifuge, as shown in FIG. 7, three zones exist: the separation zone 76', the beach zone 84' and the discharge zone 83'. The particles are introduced into the centrifuge as a slurry in the separation zone. The particles because of their larger density are consolidated at an outer position within the separation zone. The beach zone is characterized by the low liquid content of material so as to produce the mortar consistency upon the discharge of the material. The material within the beach zone 84' is essentially of a uniform consistency, and experiences no further settling as it is transported through the beach to the discharge zone. A defined interface 81' exists between the beach zone 84' and the separation zone 76'. The discharge zone 83' contains the discharge port 85' and a portion of material radially inward of the port 85' where the consistency and flow of the material is predominantly influenced by the discharge port 85'.

It is desirable to maintain a predominantly axial flow within the separation zone since such axial flow causes a minimum disturbance to the beach interface 81'. With an axial flow of liquid within the separation zone the centrifugal force on the particles is directed generally perpendicular to the initial direction of particle flow as introduced in the separation zone. As the particles are settling outward generally perpendicular to the main stream liquid flow they require a minimum time or distance to settle on the beach interface 81'. The innermost surface of mixture or beach interface 81' is maintained in close radial proximity to the slurry port 80' since this manner allows the liquid in the slurry to flow in a generally axial direction; as there is no space for the liquid portion of the slurry to flow radially which could cause disturbances at the beach interface. By controlling the flow of mixture in the beach area, the beach interfacing 81' is kept at a radial position as shown in FIG. 7.

Experimentation has shown that by configurating the inner surface of the bowl of the centrifuge, a given volume of mixture is maintained as an annulus extending substantially inward from the discharge. Such configuration controls the inner most surface of the annulus or interface 81' such that the interface is radially equidistant from the axis of rotation of the bowl resulting in a uniform flow of liquid in the separation zone. Such uniform flow results in a high efficiency of recovered particles from the slurry. While it is desirable to maintain the beach interface 81' generally radially equidistant from the axis of rotation due to differences in settling, flow rates, and characteristics of the specific particles used, an imbalance or unequal settling rates can occur along the beach interface. Such an imbalance occurs when particles are deposited at a higher rate in the area adjacent to the slurry port 80'. This additional build-up at the interface then begins to interfere with the axial flow of the liquid within the separation zone. This interference results in a material carryover or axial transport of particles along the beach interface 81'. Within limits, such material carryover is beneficial in that it contributes particles to areas of the interface where lower settling existed thereby tending to maintain a uniform cylindrical beach interface. When the carryover becomes excessive, it causes particle to particle contact interference with the particles being carried in the slurry, turbulence at the beach interface 81', and results in particles being washed out with the effluent. While as previously shown it is desirable to maintain generally cylindrical beach interface 81', a more conical interface may result from differences in settling or removal rates along the interface. In such a conical condition the interface shifts radially away from the axis of rotation as the distance from the slurry port 80' increases such a conical interface may stabilize so that the gross deposition rate generally equals the gross removal rate particles from the beach zone.

In practice the shape and characteristics of the beach and the beach interface vary for different particle concentration and particle characteristics. The material in the beach has a generally uniform consistency and as has been shown, a net uniform flow of solid particles through the beach zone can be established. The particle flow is caused by a number of forces resulting from existing conditions including the centrifugal force due to rotation, hydrostatic pressure, the interaction of one particle on another, bowl geometry, and bowl surface condition.

This specification earlier suggested that it was desirable to profile the inner bowl surfaces as mirror images, in more recent experimentation it has been determined that bowls having upper and lower surface profile, have advantages in many centrifuge operations. Independently profiling the upper and lower inner bowl surfaces gives different flow characteristics to the upper and lower beach portions.

To overcome the effects of an irregular conical or knee shaped interface 82' the flow characteristics within the volume of mixture are suitably varied. One manner in which to achieve a more uniform cylindrical surface is to profile the inner surface of the bowl to increase the flow in the portion of the bowl where a large build-up of particles is experienced, or decrease the flow in a portion of a bowl where a particle shortage occurs. As an example of such profiling in a centrifuge where a volume of material tends to build up in the lower portion forming a knee type beach interface 82', as shown in FIG. 7, a smaller initial angle $\theta_1$ is used in the lower bowl and a larger initial angle $\theta_1$ in the upper bowl to cancel out the unequal upper and lower deposit rates by using compensatingly different flow rates in the upper and lower bowl sections.

The centrifuge bowl geometry in particular the inner bowl surface profile, is chosen to produce a continuous deformation of the material in the beach zone. The beach zone is composed of a low liquid content mixture of solid particles, the consistency of which remains constant throughout. One presently preferred embodiment of this invention is a bowl centrifuge having the inner bowl surface profile configurated to maintain the bulk density of the mixture in the beach constant. As particles deposited in the beach interface 81' travel radially outward in the beach zone the bulk density of the mixture remains constant until the particles enter the discharge zone.

The inner surface of the bowl exerts a strong influence on the beach and the outward flow within the chamber. It is desirable to maintain a uniformly smooth bowl surface. In some applications due to size and consistency of the particles in the slurry and the desired discharge mixture, it is advantageous to use bowl members having a smooth uninterrupted surface. Such bowl members would then be free from surface irregularities such as may be created by seal 70. In one such present preferred embodiment of an uninterrupted centrifuge bowl surface, the discharge opening and related mechanism is located at the outermost peripheral portion of the centrifuge bowl. In such location, the inner bowl surface is uninterrupted where the surface contacts the beach. In such an embodiment the lower bowl member **24*b* would include a generally conical disc portion 42 which extend upwardly and outwardly from the portion of bowl member 24 forming the accelerator chamber. The disc portion 42 would extend uninterrupted in its interior surface radially outward to an outward edge at the position of edge 46**. In such an embodiment or similar embodiments using discharge mechanisms positioned outwardly of the inner surface of the bowl members, it is not necessary to have the bowls structurally capable of axial movement along the shaft axis. In such an embodiment, the gap formed between the upper and lower lower edges of the bowl halves remains a fixed space annular opening. This peripheral opening is then extended or exposed to produce a seriatim discharge of the mixture.

As was previously shown, the centrifuge bowl geometry and in particular the inner bowl surface profile, is chosen to provide a flow control upon the material in the beach. In addition, to inner bowl surface profiling, the outward material flow within the beach can be controlled by the surface friction exerted on the material by the inner bowl surface. The use of textured material or material with a high coefficient of sliding friction in the construction of the inner bowl surface provide for controlling the resistance to outward movement of mixture within the centrifuge bowl. In separating some slurries having particular particle characteristics such as coherence, or adherence, a smooth polished interior surface can be used.

Inactive or dead zones, where there is little or no outward flow of mixture, tend to impede the particle flow through the beach volume. Such dead zones result in the loss of the control gained by the friction and profiling of the inner bowl surface. A smooth inner bowl surface reduces inactive zones.

Once the profile of the bowl has been established with reference to the settling characteristics of the incoming slurry, the flow characteristics of the mixture, and other specific conditions indicative of the backfill operation, the rate of separation and the rate of discharge are used to control the centrifuge. The rate of separation is controlled by varying the rotational speed of the shaft 14. The rate of discharge is controlled by varying the parameters of the discharge gap. Operation of the centrifuge includes a fixed gap-variable speed mode, a fixed speed-variable gap mode, or variable speed-variable gap mode. In any of these control modes, a primary consideration is to maintain an adequate volume of mixture within the chamber while continuously discharging. Regardless of the mode of operation used, the beach is maintained within the range of volume defined by the blow-out radius and the wash-out radius. In practice one such range of volumes for example varied between 25 to 95% of volume of a 24 inch diameter centrifuge chamber. The volume of the mixture is maintained at a given value by regulating the deposition rate of particles entering the beach to equal the rate of discharge of particles from the discharge zone. For a given fixed discharge gap the rate of discharge varies with the speed of rotation of the bowl. If the centrifuge operation is regulated by varying the speed of rotation, it is desirable to operate the centrifuge in a range of speeds below the critical speed. The critical speed is that speed at which the rate of deposition equals the rate of removal for the maximum operating discharge gap.

It has been previously taught in this specification that the beach zone can be initially established by rotating the centrifuge at a speed less than the operating speed of the centrifuge while keeping the discharge gap closed. Establishing the beach at this lower speed is satisfactory; but practice has shown that a beach is established at the operating speed or during acceleration to the operating speed. One present preferred method for establishing the beach includes introducing a flow of slurry into the centrifuge through the acceleration chamber 26 and removing the overflow through discharge ports 32, while accelerating the centrifuge to operating speed. During this time the discharge gap is held closed so that no solids or liquid is discharged through the discharge port. When the centrifuge is up to operating speed and an adequate beach has been established, the discharge port is opened to initiate a flow of particles through the beach area. One of the advantages of establishing the beach at the operating speed is that motor speed control need not operate over a wide speed range.

The present preferred embodiments have been described wherein the slurry is composed of a mixture of water and solid particles of mill tailings it is understood that liquid vehicles other than water and solids other than mill tailings can be used. When such other materials are used the specific parameters of bowl profile, speed, feed rates, discharge rates, and bowl surface are determined by the principles herein described.

While the embodiments previously shown are directed primarily to the separation of specific copper tailings for backfill, it is understood that variation in the particle characteristics and separation requirements may require the patent to be practiced in a form that is a departure from the embodiments described herein. It will be recognized that regardless of the specific application of the centrifuge, this invention solves the problem in separating a slurry containing solid particles into a low liquid content mixture having a consistency of a mortar and into a high liquid content portion while continually discharging such mixture.

Although a preferred embodiment of this invention and specific modifications thereof have been described herein in accordance with the patent statutes still other modifications can be made without departing from the spirit and scope of the invention. Accordingly, the following claims are to be construed in accordance with the knowledge of one skilled in the art to which this invention relates.

We claim:

1. The method of separating a slurry of solid particles entrained in a fluid vehicle into an effluent component primarily consisting of the fluid vehicle and a relatively heavier centrifuged product component primarily consisting of a mass of the particles within a centrifuge including an elongated shaft member rotatable about the central longitudinal axis thereof and a pair of formed bowl members defining a centrifuge chamber carried by such shaft member for rotation therewith and which bowl members have a peripheral portion spaced radially outermost from said central axis selectively capable of preventing or permitting the flow of the centrifuged product component therethrough; comprising: separating portions of such a slurry, continuously admitted throughout an initial period of time interiorly of such bowl members with said peripheral portion preventing the flow of the centrifuged product component therethrough during continuous rotation of such bowl members, into such a product component which increases in radial extent with respect to said axis throughout said initial period until a mass thereof extends from the interior of such peripheral portion to radially outwardly adjacent such shaft with the portion of said mass adjacent said shaft defining an elongated unobstructed passageway axially encompassing the full extent of such shaft within said bowl members and with said passageway having a lateral extent substantially less than the maximum radial extent of said mass and into such an effluent component while discharging portions of such effluent component exteriorly of such bowl members from one axial end of said passageway; discharging portions of said mass through said peripheral portion over an immediately subsequent period of time while maintaining the rotation of said bowl members while simultaneously separating additional portions of such slurry admitted on a continuous basis to the interior of the bowl members into such product component and such effluent component at a rate that increments of said product component are added to said mass to maintain the radial extent of said mass substantially uniform throughout said subsequent period of time; and simultaneously throughout said subsequent period of time continuously discharging portions of such effluent component of said additional portions of such slurry from said one axial end of said passageway.

2. The method as set forth in claim 1 further including maintaining such radial extent by controlling the flow of said mass by the interior surface of said bowl members.

3. A method as set forth in claim 1 wherein said discharging of said mass is continuous.

4. The method of claim 1 wherein during said immediately subsequent period of time said mass continuously flows towards said peripheral portion at a controlled rate.

5. The method of claim 1 wherein said continuous flow is retarded at a greater rate as the distance from said axis radially increases.

6. A method as set forth in claim 1 wherein said discharging of said means is of a continuous circumferential radial outermost portion of said mass.

7. A method as set forth in claim 6 wherein said discharging of said mass is of a variable portion of the radially outermost portion of said mass.

8. A method as set forth in claim 1 wherein during said immediately subsequent period of time said mass moves radially outwardly from said shaft at a uniform rate.

9. A method as set forth in claim 1 wherein the rate of said discharging of said mass is variable.

10. A method as set forth in claim 1 wherein the location of the interface between said mass and said passageway radially shifts during said immediately subsequent period of time to maintain said rate.

11. The method of conditioning a centrifuge for subsequent operation which centrifuge has (1) an elongated shaft member rotatable about the central longitudinal axis thereof, (2) a pair of formed bowl members defining a centrifuge chamber rotatably carried by such a shaft member with at least one of said bowl members having at least a portion thereof axially positionable with respect to such shaft member and (3) means in at least one of such members for admitting a slurry of solid particles entrained in a fluid vehicle into such chamber over a selectable period of time; comprising: continuously separating such a slurry, continuously admitted throughout an initial period of time interiorly of such bowl members during continuous rotation of such bowl members with peripheral portions of such bowl members radially outwardly of such axis being in continuous engagement with each other, into a product component primarily consisting of a mass of such particles which increases in radial extent with respect to said axis throughout said initial period until said mass extends from the interior of said engaged peripheral portions to radially outwardly adjacent such shaft with the portion of said mass adjacent said shaft defining an elongated unobstructed passageway axially encompassing the full extent of such shaft within said bowl members and with said passageway having a lateral extent substantially less than the maximum radial extent of said mass; and into an effluent component primarily consisting of such fluid vehicle; and simultaneously discharging portions of said effluent component exteriorly of such bowl members.

12. A method of operating a bowl centrifuge in which a slurry consisting of solid particles entrained in a liquid has been separated into a liquid portion which is discharged from said bowl centrifuge and a mixture portion consisting of cenrifuged particles and liquid within a radially outer section of such bowl, comprising: maintaining the volume of said mixture portion within a range of volumes as an annulus within said outer section to permit simultaneous discharge of seriatim portions of said mixture portion from radially outermost portions of said volume while replenishing said mixture portion by continuous centrifugal separation of supplied additional slurry.

13. The method as set forth in claim 12 wherein said maintaining is of a volume within said range of volumes.

14. The method as set forth in claim 12 wherein said maintaining is within said range of volumes with the minimum volume thereof being a volume corresponding to an annular volume having an innermost radius at least slightly greater than the blow-out radius.

15. The method as set forth in claim 12 wherein said range of volumes includes those volumes between 25% and 95% of the volume of said bowl.

16. A method as set forth in claim 12 in which the average rate of particle discharge from said mixture portion is substantially equal to the average rate of particle replenishment of said volume during said maintaining.

17. A method as set forth in claim 12 wherein said maintaining of said volume is by varying the flow of said mixture portion within said volume.

18. The method as set forth in claim 12 further comprising: maintaining a flow of said mixture portion in the uppermost axial portion of said volume at a first selected rate; and maintaining a flow of said mixture portion in the lowermost axial portion of said volume at a second selected rate.

19. The method as set forth in claim 18 wherein said second selected rate equals said first selected rate.

20. The method as set forth in claim 12 further comprising: controlling the flow of said mixture portion through said volume to maintain said volume as an annulus extending substantially inward from said outermost portion of said volume and having an innermost surface spaced substantially equidistant from said axis.

21. The method as set forth in claim 20 wherein said slurry is introduced into said bowl centrifuge at a slurry port adjacent one end of the axis of the bowl and said liquid portion is discharged axially adjacent the end opposite said one end, further comprising: controlling said flow through said volume to maintain said inner surface of said volume outwardly adjacent said slurry port.

22. A method as set forth in claim 12 wherein said maintaining of said volume is by varying the rate of separation of said slurry.

23. A method as set forth in claim 12 wherein said maintaining of said volume is by varying the rate of discharge of said mixture portion from said volume.

24. A method as set forth in claim 12 wherein said maintaining of said volume is by varying the speed of rotation of such centrifuge.

25. A method as set forth in claim 12 wherein said maintaining of said volume is by varying the rate at which additional slurry is supplied.

26. A method of conditioning a centrifuge for subsequent operation such centrifuge having (1) an elongated shaft member rotatable about the central longitudinal axis thereof (2) a pair of formed bowl members defining a centrifuge chamber carried by such shaft member and rotatable therewith (3) admitting means in at least one of said members for admitting a slurry of solid particles entrained in a fluid vehicle into such chamber (4) said bowl members having a discharge opening from said chamber at a radailly outer peripheral position from the axis of rotation of said bowl member comprising: centrifugally separating slurry admitted into said chamber into a high liquid content portion and a mixture portion consisting of particles and liquid, while discharging said high liquid content portion, while retaining said mixture within an outer section of such chamber until said mixture constitutes an annular volume of said mixture extending inward from the outermost portion of said chamber to a position radially outwardly adjacent said shaft and defines an elongated unobstructed passageway axially encompassing the shaft within said chamber with a radial extent substantially less than the radial extent of said mixture.

* * * * *

UNITED STATES PATENT AND TRADEMARK OFFICE

CERTIFICATE OF CORRECTION

PATENT NO. : 4,432,748

DATED : February 21, 1984

INVENTOR(S) : John Novoselac; Dale L. Churcher

It is certified that error appears in the above-identified patent and that said Letters Patent are hereby corrected as shown below:

Column 15, line 67 delete "means" and substitute -- mass --.

Signed and Sealed this

*Ninth* Day of *October 1984*

[SEAL]

*Attest:*

GERALD J. MOSSINGHOFF

*Attesting Officer*

*Commissioner of Patents and Trademarks*